United States Patent [19]

Stewart et al.

[11] Patent Number: 4,561,958

[45] Date of Patent: Dec. 31, 1985

[54] ALUMINA REDUCTION CELL

[75] Inventors: Douglas V. Stewart, Florence; Alton T. Tabereaux, Sheffield, both of Ala.

[73] Assignee: Reynolds Metals Company, Richmond, Va.

[21] Appl. No.: 677,088

[22] Filed: Nov. 30, 1984

[51] Int. Cl.[4] ..... C25C 3/00

[52] U.S. Cl. ..... 204/243 R; 501/90; 501/94; 501/95; 501/99; 501/100; 501/133; 501/127; 501/128

[58] Field of Search ..... 204/243 R; 501/88–89, 501/90, 92, 95, 96, 127, 128, 99–100, 133, 98, 94

[56] References Cited

U.S. PATENT DOCUMENTS

| | | | |
|---|---|---|---|
| 3,031,322 | 4/1962 | Bugosh | 106/286 |
| 3,164,482 | 1/1965 | Renkey | 106/44 |
| 3,256,173 | 6/1966 | Schmitt et al. | 204/243 |
| 3,321,392 | 5/1967 | McMinn et al. | 204/243 |
| 3,499,831 | 3/1970 | McMinn et al. | 204/243 R |
| 3,514,520 | 5/1970 | Bacchiega et al. | 13/35 |
| 3,764,509 | 10/1973 | Etzel et al. | 204/243 R |
| 3,979,214 | 9/1976 | Trostel, Jr. | 106/44 |
| 4,014,705 | 3/1977 | Yale | 106/50 |
| 4,039,342 | 8/1977 | Reerink et al. | 106/58 |
| 4,208,214 | 6/1980 | Stein et al. | 501/95 |
| 4,218,254 | 8/1980 | Kiehl et al. | 106/44 |
| 4,411,758 | 10/1983 | Hess et al. | 204/243 R |
| 4,436,597 | 3/1984 | Hartley, II | 204/243 R |

*Primary Examiner*—R. L. Andrews

*Attorney, Agent, or Firm*—Alan T. McDonald

[57] ABSTRACT

An improved alumina reduction cell is disclosed. Vapor barriers, formed from a castable refractory and a silicon carbide mortar protect the bottom and sidewall insulation material of the cell from attack by the corrosive materials contained within the cell.

19 Claims, 1 Drawing Figure

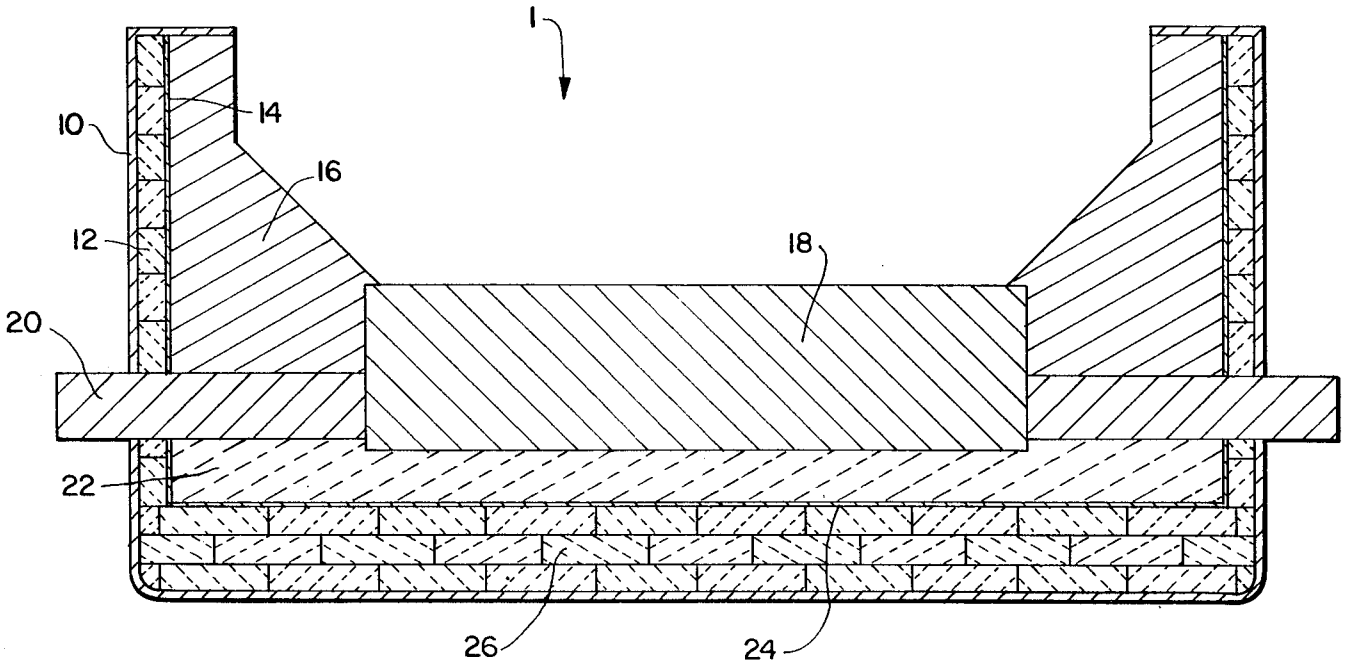
1
10
12
14
16
18
20
22
24
26

ALUMINA REDUCTION CELL

BACKGROUND OF THE INVENTION

The general construction design for an alumina reduction cell cathode comprises an outer open-top steel shell, several layers of high, intermediate and low temperature insulation refractories on the bottom of the steel shell and, in some instances, on the sidewalls of the steel shell, a layer of prebaked and/or monolithic rammed carbon on the bottom and sidewalls of the cell, a monolithic, prebaked carbon cathode on the floor of the cell, and busbars extending from the carbon cathode through the sidewalls of the cell for connection to an electrical system supplying the current necessary for reduction of alumina contained in the cell to aluminum.

An alumina reduction cell requires adequate insulation on the bottom and sidewalls of the cathode to limit heat losses from the steel shell during cell operation. Cryolitic salts and vapors, containing an excess of sodium fluoride, penetrate through the carbon bottom and sidewalls during operation of the cell over its normal four to six year lifespan, and chemically attack and degrade the insulation. As the insulation is degraded, it loses its effectiveness as a thermal insulation material and heat losses through the insulation increase. As a consequence, the cell voltage must be increased to maintain a stable thermal equilibrium in the cell. If the cell voltage is not increased, the temperature of the cryolite-alumina electrolyte decreases, resulting in an increase in anode effect frequency from a normal average of one anode effect per day per cell to about two to three anode effects per day per cell.

An increased anode effect frequency significantly decreases the productivity of the potline to which the cell is connected. First, the productivity of the cell experiencing the anode effect is reduced due to increased bath temperature and increased turbulence within the cell occurring during the anode effect. Additionally, the line amperage of all the reduction cells in the potline is affected. Alumina cells in a potline are connected in an electrical series. When an anode effect occurs in one of the cells, the line amperage typically decreases between about 3000 to 5000 amps, due to the high voltage, approximately 20 to 50 volts, on the cell having the anode effect, as opposed to the typical 5 to 7 volts of a normal cell. Thus, the productivity of all cells in the potline decreases during each anode effect.

Thus, as is readily apparent, increased heat losses from cathodes, as a result of degradation of the insulation by cryolitic salts, results in an increase in energy consumption and/or decrease in productivity of the cells.

The highly corrosive cryolitic salts and vapors penetrating the cathode can be stopped in one of two ways. The temperature isotherm directly above the insulation material may be kept sufficently low, typically below about 600° C. to prevent any mobility of the salts below their freezing point. Alternatively, a vapor-proof barrier that will effectively resist the chemical attack of the cryolitic salts for the life of the cathode may be maintained in the cell.

In modern reduction cells, heat losses from the bottom and sides are reduced to conserve energy by adding additional layers of insulation and/or using insulation with lower thermal conductivities. This results in temperature isotherms directly above the insulation greater than about 800° C., due to the reduction of heat flow through the insulation. Because of this higher surface temperature, the insulation will be attacked and degraded faster by the cryolitic salt vapors as the temperature isotherm at the surface of the insulation exceeds the freezing point of the salts, typically in the range of 700° to 800° C. Thus, reliance upon vapor barriers is the only viable alternative in modern alumina reduction cells for insulation protection.

Various materials have been used in the past to protect alumina reduction cell insulation material. For example, mild steel is often placed over the insulation material forming the bottom of the cell. While steel barriers are somewhat effective, they are themselves attacked and eroded by the cryolithic material, usually within about two to three years, and sooner if the carbon cathode develops cracks.

There are other disadvantages to be noted when employing steel as a barrier material. Increased steel thickness will gain only slightly increased barrier life, but at a substantial increased cost. Thus, the cost-benefit ratio of steel is poor. It is also difficult and expensive and to purchase a large, one-piece sheet of steel sufficient to cover the entire bottom surface of the cathode. At the same time, welding several smaller pieces of steel together will cause the composite sheet to warp, causing voids in the insulation.

Substituting stainless steel for mild steel does increase the barrier properties, but at a cost prohibitively high and with significant increased difficulty of welding.

Another approach used for protecting the floor insulation of a cell is a mortared layer of fire brick or tile. These tiles or bricks are joined with a high temperature mortar. While used extensively abroad, such barriers have not gained acceptance in the United States, due to the exceptionally high cost in increased construction time resulting from the brick laying process, both in materials and labor. Further, even when installed, there is a weak link in this system, namely, the mortar. The mortar does not have the same physical and chemical resistance as the bricks to the cryolitic salts. As a result, cryolitic salts and vapors eventually penetrate through the mortar, around the bricks, and attack the insulation.

Recently, it has been proposed to employ a layer of glass sandwiched between alumina silicate fiber blankets to form a thin chemical barrier against cryolitic salts, due to the formation of higher melting point compounds, such as napthalenes, etc. Although this concept appeared feasible during a one-year experiment, it has not proven successful in barring cryolitic salts and vapors for the full four to six year lifetime of a cell. It has been found that the higher melting point compounds will be attacked, dissolved and degraded by the highly corrosive cryolitic salts and that the overwhelming supply of semi-molten cryolitic salts and vapors attacks and corrodes the relatively thin glass layer. For example, in a typical alumina reduction cell, the cathode weight often doubles during the four to six year life of cell operation due to the absorption of cryolitic salts into the cathode lining. The relatively thin glass layers have been unable to withstand this quantity of corrosive material.

There is a need, therefore, for a vapor barrier to protect the insulation layers on the bottom of an electrolytic alumina reduction cell. There is also a need for a vapor barrier which may be employed on the sidewalls of a alumina reduction cell having insulated sidewalls. It is thus the primary objective of the present invention to provide such vapor barriers.

THE PRESENT INVENTION

By means of the present invention, this goal is obtained. According to a first aspect of the present invention, a castable refractory layer is formed upon the insulation material on the floor of the cell.

Accordingly to a second aspect of the present invention, the insulation material on the sidewalls of the cell, and optionally, on the floor of the cell, are coated with a silicon carbide mortar. If the silicon carbide mortar is employed on the bottom of the cell, the castable refractory is formed thereon.

The castable refractory and mortar layers act as vapor barriers for the insulation material, thus increasing the useful life of the insulation material and decreasing the cost of operation of the cell over an extended period of time.

BRIEF DESCRIPTION OF THE DRAWING

The FIGURE in the drawing is a cross-sectional view of the cathode of an alumina reduction cell employing the protective barrier layers of the present invention.

DETAILED DESCRIPTION OF THE PREFERRED EMBODIMENTS

Turning now to the FIGURE, an alumina reduction cell cathode 1 is shown in cross section. The cell 1 includes a generally rectangular shaped open top steel shell 10, several layers of high, intermediate and low temperature insulation refractories 26 on the bottom and within shell 10, a layer of insulation refractory 12 on the sidewall of the shell 10, a layer of prebaked and/or monolithic rammed carbon 16 on the bottom and sidewal1s of cell 1, a carbonaceous cathode 18 and busbars 20 which connect the cathode 18 to a source of electrical current.

The insulation block layers 12 and 26 are covered with vapor barrier layers 14 and 24 respectively. The vapor barrier layers 14 and 24 are formed from a silicon carbide mortar. The mortar is formed from a composition comprising from about 5 to about 10 percent by weight water and from about 90 to about 95 percent by weight of a mixture comprising about 75 to about 85 percent by weight silicon carbide and from 15 to about 25 percent by weight of a binder. The binder may be, for example, sodium aluminate, silicate or phosphate.

The vapor barrier layers 14 and 24 are formed from the composition as stated above and applied while still wet to the insulating block layers 12 and 26 and a thickness ranging from about $\frac{1}{8}$ to about 1" in thickness, preferably about $\frac{1}{4}$" thick.

The vapor barrier layers 14 and 24 provide several advantages. Silicon carbide mortar has been proven to be effective in resisting attack by molten cryolite when employed as a mortar between silicon carbide bricks in the sidewalls of alumina reduction cells and thus act in the same manner to resist molten cryolite as a mortar covering insulating blocks 12 and 26. Silicon carbide mortar forms a strong bond to steel and refractories at elevated temperatures, thus helping to ensure stability to the cell over its life span. Silicon carbide mortar forms a good air setting bond, and can be cured completely when the cell is baked or started. Silicon carbide mortar can be easily applied to refractory bricks or insulating slabs prior to their installation, but are preferably applied directly to the bricks or insulating slabs after they have been installed in place on the cathode. Silicon carbide mortar provides chemical protection for refractory bricks or insulating slabs in the sidewalls against both cryolite salts and vapors from the electrolyte, and from molten aluminum. This will prevent the molten aluminum from penetrating the carbon cathode through cracks and attacking the insulation and/or providing increased transport of cryolitic salts into the insulation.

On the bottom of cell 1, another vapor barrier is employed. A one-piece vapor barrier consisting of a castable refractory 22 covers the insulating blocks 26 on the floor of the cell. As illustrated in the FIGURE, castable refractory layer 22 is formed on mortar layer 24. However, this is not required. If mortar layer 24 were not employed, then layer 22 would be formed directly on insulation blocks 26. This would normally be the case, if insulating blocks 12, and thus mortar 14, were not employed, but may also be the case where blocks 12 and 14 are employed.

The castable refractory 22 comprises from about 75 to about 94.5 percent by weight of a refractory comprising from 5 to about 10 percent by weight water, from about 45 to about 55 percent by weight alumina and from about 40 to about 50 percent by weight silica, from about 0.5 to about 5.0 percent by weight fibers, and from about 5 to about 20 percent by weight filler. The fibers may be formed of such materials as stainless steel, silicon carbide, carbon, aluminum silicate and the like and may range from about 1 to about 2 centimeters in length. The filler may be formed from, for example, silica or silicon carbide particles having a particle diameter of from about 1 to about 15 microns. The castable refractory layer 22 may have a thickness, for example, of from about 2 to about 6 inches.

The castable refractory layer 22 provides several advantages to an alumina reduction cell. The one-piece monolithic castable refractory layer 22 eliminates seam weakness inherrent in brick or other similar barriers. The castable refractory 22 also provides chemical resistivity equal to that of fire brick or tiles. The utilization of fibres of appropriate length in the monolithic layer 22 provides crack arresters to inhibit cracking during baking, startup and operation of the cell, increasing the stability of layer 22 and thus the life of the cell, as well as reducing locations for migration of cryolitic salts to the insulation layers 26. The filler material reduces thermal expansion and increases density of the monolithic layer 22. The low linear shrinkage, which is typically less than about 0.5 percent, of the monolithic castable refractory layer reduces chances for cracking. The high bulk density and low porosity of castable refractory layer 22 reduces penetration and reaction by cryolitic salts and vapors.

The castable refractory layer 22 is formed by mixing the appropriate amount of water with the other component materials until the mix is uniformly wet and homogeneous and the mix is then poured into the cathode, spread and smoothed with a rotary blade cement finisher. The castable refractory is cured by holding the cell 1 at ambient temperature of between about 25° and 35° C. for 24 hours, slowly heating the cell 1 at rate of about 25° C. per hour until the layer 22 reaches about 110° C., holding the layer 22 at about 110° C. for about 24 hours, heating the cell 1 at a rate between about 50° and 75° C. per hour until the layer 22 reaches about 600°

C. and holding the cell 1 at about 600° to 700° C. for 24 hours.

From the above, it is clear that the vapor barrier protection for an alumina reduction cell cathode provided by the present invention results in a cathode of increased life and/or increased productivity during its effective life.

While the invention has been described with reference to certain specific embodiments thereof, it is not intended to be so limited thereby, except as set forth in the accompanying claims.

We claim:

1. In an alumina reduction cell comprising a steel outer shell, thermal insulation material on the floor and within said shell, a carbonaceous cathode on said thermal insulation material and carbonaceous sidewalls within said shell the improvement comprising a castable refractory vapor barrier layer interposed between said cathode and said thermal insulation material, said castable refractory vapor barrier layer comprising from about 75 to about 94.5 percent by weight of a refractory comprising from about 5 to about 10 percent by weight water, from about 45 to about 55 percent by weight alumina and from about 40 to about 50 percent weight silica, from about 0.5 to about 5 percent by weight fibers and from about 5 to about 20 percent by weight filler.

2. The cell of claim 1 wherein said thermal insulation material comprises layers of high, medium and low temperature insulation refactories.

3. The cell of claim 1 wherein said fibers comprise stainless steel, silicon carbide, carbon or aluminum silicate.

4. The cell of claim 3. wherein said fibers have a length ranging from about 1 to about 2 centimeters.

5. The cell of claim 1 wherein said filler comprises silica or silicon carbide particles.

6. The cell of claim 5 wherein said particles have a particle diameter ranging from about 1 to about 15 microns.

7. The cell of claim 1 wherein said castable refractory has a thickness ranging from about 2 to about 6 inches.

8. The cell of claim 1 wherein a second thermal insulation material is interposed between said shell and said carbonaceous sidewalls and wherein a silicon carbide mortar is interposed between said second thermal insulation material and said carbonaceous sidewalls.

9. The cell of claim 8 wherein said silicon carbide mortar comprises from about 5 to about 10 percent by weight water and from about 90 to about 95 percent by weight of a mixture comprising from about 75 to about 85 percent by weight silicon carbide and from about 15 to about 25 percent by weight binder.

10. The cell of claim 9 wherein said binder comprises sodium aluminate, sodium silicate or sodium phosphate.

11. The cell of claim 8 wherein said silicon carbide mortar has a thickness ranging from about $\frac{1}{8}$ to about 1 inch.

12. The cell of claim 1 wherein a silicon carbide mortar is interposed between said castable refractory vapor barrier layer and said thermal insulation material.

13. The cell of claim 12 wherein said silicon carbide mortar comprises from about 5 to about 10 percent by weight water and from about 90 to about 95 percent by weight of a mixture comprising from about 75 to about 85 percent by weight silicon carbide and from about 15 to about 25 percent by weight binder.

14. The cell of claim 13 wherein said binder comprises sodium aluminate, sodium silicate or sodium phosphate.

15. The cell of claim 14 wherein said silicon carbide mortar has a thickness ranging from about $\frac{1}{8}$ to about 1 inch.

16. The cell of claim 8 wherein said silicon carbide mortar is interposed between said castable refractory vapor barrier layer and said thermal insulation material.

17. The cell of claim 16 wherein said silicon carbide mortar comprises from about 5 to about 10 percent by weight water and from about 90 to about 95 percent by weight of a mixture comprising from about 75 to about 85 percent by weight silicon carbide and from about 15 to about 25 percent by weight binder.

18. The cell of claim 17 wherein said binder comprises sodium aluminate, sodium silicate or sodium phosphate.

19. The cell of claim 16 wherein said silicon carbide mortar has a thickness ranging from about $\frac{1}{8}$ to about 1 inch.

* * * * *